United States Patent [19]

Dachtler

[11] 4,296,902

[45] Oct. 27, 1981

[54] BABY BOTTLE SUPPORT JIG

[76] Inventor: William G. Dachtler, 1021 Emory, Imperial Beach, Calif. 92032

[21] Appl. No.: 74,004

[22] Filed: Sep. 10, 1979

[51] Int. Cl.[3] ..... A47D 15/00

[52] U.S. Cl. ..... 248/102

[58] Field of Search ..... 248/102, 103, 104, 105, 248/106, 107, 470, 476; 224/257, 258, 265; 350/298; D24/48

[56] References Cited

U.S. PATENT DOCUMENTS

| | | | |
|---|---|---|---|
| 1,863,163 | 6/1932 | Malti et al. | 248/102 |
| 2,201,257 | 5/1940 | Bell | 248/105 |
| 2,211,227 | 8/1940 | Feindel | 248/106 |
| 2,304,705 | 12/1942 | Pate | 224/258 |
| 2,327,096 | 8/1943 | Dann | 350/298 |
| 2,530,478 | 11/1950 | Parent | 248/103 |
| 2,552,844 | 5/1951 | Clinehens | 248/106 X |
| 2,583,803 | 1/1952 | Amer | 224/265 X |
| 2,912,200 | 11/1959 | Reinhorn | 248/103 |
| 2,953,337 | 9/1960 | Valis | 248/102 |

*Primary Examiner*—William H. Schultz

*Attorney, Agent, or Firm*—Ralph S. Branscomb

[57] ABSTRACT

The invention is a device for supporting a baby bottle in a position in which the baby is nursing in a reclined or seated position and comprises a soft strap passing around the back of the baby's neck connecting to a pair of arcuate support arms passing down against the baby's chest and up to a support ring through which the baby bottle passes, enabling the baby to nurse without his mother's presence.

5 Claims, 5 Drawing Figures

BABY BOTTLE SUPPORT JIG

BACKGROUND OF THE INVENTION

When a baby is in a reclined position in a crib or in bed or seated in a highchair and is provided with a baby bottle, inevitably the baby bottle will roll off to one side of the baby's chest if the mother is not present to hold it in position. Mothers typically will place a pillow on the baby's chest to nestle the bottle such that it doesn't fall off, and certain other techniques have been used.

However, there is no simple, reliable and safe device available for use to maintain a baby bottle in position so that the baby may nurse without enduring the frustration of losing his bottle.

SUMMARY OF THE INVENTION

The present invention fulfills the above-mentioned need by providing a jig comfortably supported around the baby's neck and against his chest which will hold a bottle while the baby is nursing. It is provided in several modified embodiments incorporating features of adjustability of the length of the soft neck strap, vertical adjustability of the ring or cradle holding the bottle, and rotative adjustability around a horizontal axis for the bottle support ring, so that every aspect of the baby's anatomy and the possible differences in anatomy from one baby to the next are taken fully into account by the provision of a totally adjustable and repositionable baby bottle support jig.

DETAILED DESCRIPTION OF THE PREFERRED EMBODIMENT

Figure 1:
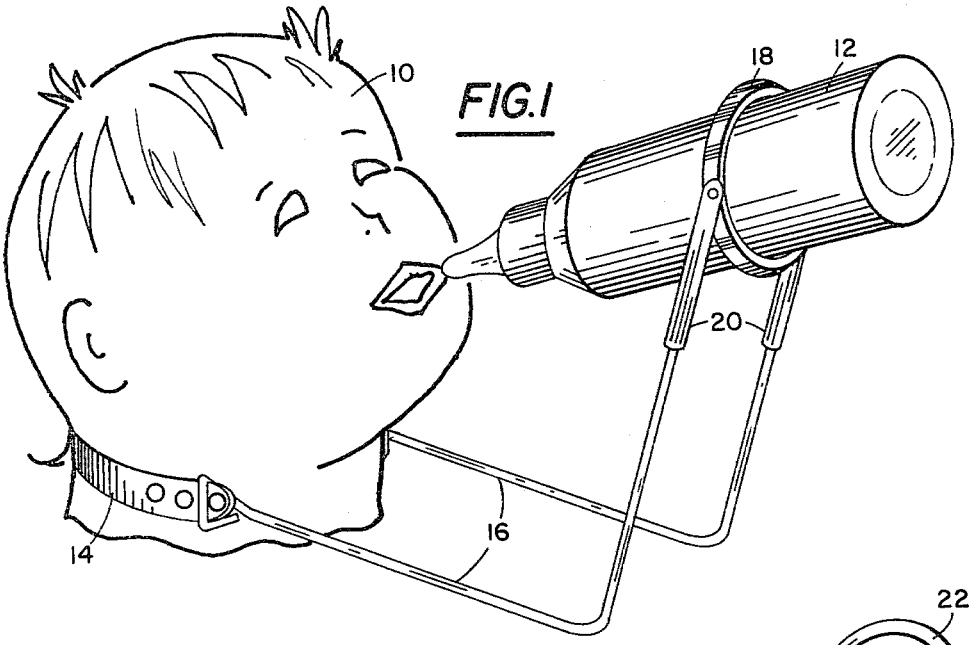
FIG. 1 is a perspective view of one form of the device having an adjustable neck strap, telescopically adjustable ring and a pivotal ring deployed on a baby in seated position.

In FIG. 1 a baby 10 can be seen in seated position nursing on a baby bottle 12. In this particular embodiment of the invention, a soft strap 14 passes behind the baby's neck and to the front ends of the soft strap connect a pair of arcuate support arms 16 which pass down into contact with the baby's chest and then up into proximity with a loop cradle 18 which in the form shown in FIG. 1 is mounted on a pair of sleeves 20 which frictionally engage the ends of the support arms 16 so that the loop 18 is vertically adjustable by virtue of this telescopic interplay. This adjustability, in addition to suiting different babies, enables the jig to be more easily used alternatively in seated or reclined position.

Figure 2:
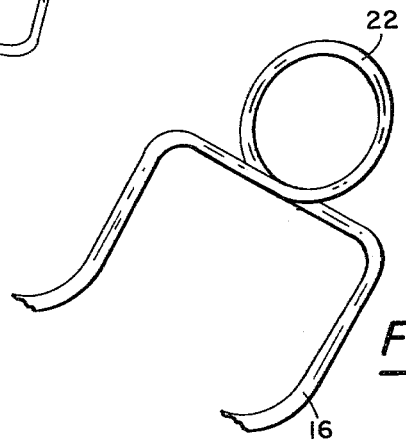
FIG. 2 is a fragmentary perspective of a form of the support cradle comprising a wire loop.

FIG. 2 illustrates an embodiment of the invention somewhat simpler than that set forth in FIG. 1 wherein the two support arms 16 are integral and their upper end and define a loop 22. This embodiment is by far the simplest of those shown and has been found to be quite adequate, although for some applications some of the fancier modifications might be more appealing.

Figure 3:
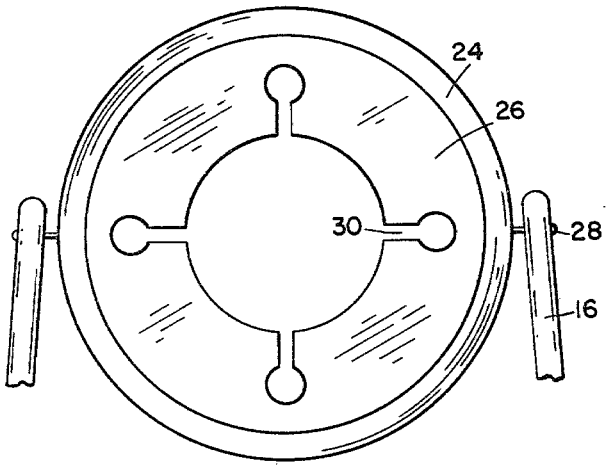
FIG. 3 is a front elevation view of a modification of the bottle-holding loop incorporating a frictional collar.

FIG. 3 represents a modification wherein the cradle is defined by a ring 24 having an inwardly directed resilient collar 26 of rubber, or the like. This whole mechanism is pivoted at 28 to the upper ends of the support arm 16 and it can be seen that the resilient interior of the collar 26, which is also slit at 30, will grip a bottle passed therethrough with a positive frictional force. This positive gripping coupled with the pivotable characteristic of the ring insures that the bottle is somewhat angularly adjustable in the baby's mouth so the risk that both angular and longitudinal rigidity would pose an uncomfortable burden on the baby is avoided.

Figure 4:
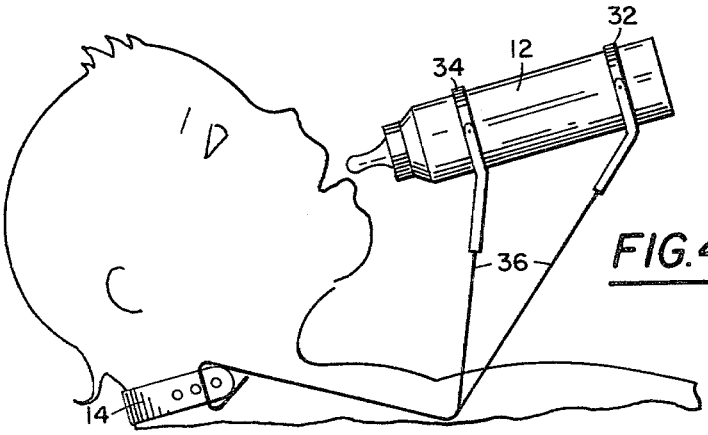
FIG. 4 is a side elevation view of a modification of the jig in use on a reclining baby utilizing a pair of spaced bottle-holding rings.

FIG. 4 is illustrative of another modification wherein a first loop 32 is mounted on the ends of the support arm 16 and a second loop 34 is mounted on a second pair of support arms 36 which extend up from the primary arms 16. The obvious advantage of this embodiment is the stability of the bottle against twisting.

Figure 5:
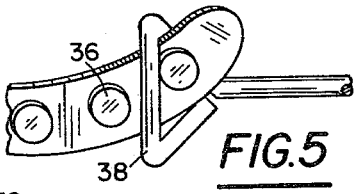
FIG. 5 is a detail of the adjustable feature of the neck strap.

As indicated in FIG. 1, the loop 18 is adjustable upwardly and downwardly to accommodate babies of different size and the strap 14 is also provided at both ends with snaps 36 which engage the arms 16 through loops 38 so that the strap is lengthwise adjustable, as indicated by FIG. 5, and is also removable for washing and replacement.

It can thus be seen that with its various features of adjustability and its various alternative embodiments, the baby bottle holding jig of the instant invention will accommodate the needs of every baby and every parent and eliminate a lot of the frustration felt by both resulting from the falling of the baby bottle away from the baby's mouth during nursing.

What is claimed is:

1. A baby bottle support jig comprising:

(a) a soft strap to loop over the head and pass behind the neck of a baby in a reclining position;

(b) a pair of substantially rigid support arms having ends lying alonside the opposite sides of the neck and being connected respectively to the ends of said strap, passing down in contact with the baby's chest, and extending to upper ends spaced from the baby's face and chest; and (c) a bottle-holding cradle mounted to the upper ends of said support arms, whereby a baby bottle with the nipple thereof in the baby's mouth can be supported at its upper portion in said cradle.

2. The structure according to claim 1 wherein said cradle comprises a loop and said loop is mounted on a pair of sleeves frictionally engaging the ends of said support arms whereby said loop is adjustable up and down on said support arms by virtue of being telescopically received thereon.

3. The structure according to claim 1 wherein said strap is lengthwise adjustable on said support arms.

4. The structure according to claim 1 wherein said cradle is annular and includes an inwardly extending substantially flexible split ring collar to positively grip the sides of a baby bottle passed therethrough.

5. Structure according to claim 3 wherein the end of at least one of said arms defines a loop and one end of said strap is provided with a plurality of spaced fasteners to selectable engage said loop.

* * * * *